US005226935A

United States Patent [19]

Wolff et al.

[11] Patent Number: 5,226,935

[45] Date of Patent: Jul. 13, 1993

[54] AIR HUMIDIFICATION APPARATUS

[75] Inventors: Pør Wolff, Birker ød; Bjarne Bernt, Bagsværd, both of Denmark; Lasse Hessel, Reading, Great Britain

[73] Assignee: Skandinavisk Miljo System A/S, Hellerup, Denmark

[21] Appl. No.: 861,872

[22] PCT Filed: Dec. 7, 1990

[86] PCT No.: PCT/DK90/00321

§ 371 Date: Jun. 19, 1992

§ 102(e) Date: Jun. 19, 1992

[87] PCT Pub. No.: WO91/09256

PCT Pub. Date: Jun. 27, 1991

[30] Foreign Application Priority Data

Dec. 8, 1989 [DK] Denmark ..... 6197/89
May 2, 1990 [DK] Denmark ..... 1091/90

[51] Int. Cl.[5] ..... F24F 6/04

[52] U.S. Cl. ..... 55/257.5; 239/20; 239/193; 261/37

[58] Field of Search ..... 55/257.5; 239/17, 20, 239/193, 194; 261/37

[56] References Cited

U.S. PATENT DOCUMENTS

| | | | |
|---|---|---|---|
| 763,614 | 6/1904 | Keith . | |
| 1,291,926 | 1/1919 | Kleucker | 239/193 |
| 2,225,836 | 12/1940 | Lund | 239/193 |
| 2,395,960 | 3/1946 | Clark et al. | 55/257.5 |
| 3,211,378 | 10/1965 | Zysk | 239/20 |
| 3,451,622 | 6/1969 | Forney | 239/20 |
| 4,149,674 | 4/1979 | Fukamizu et al. | 239/20 |
| 4,217,315 | 8/1980 | Keeler . | |
| 4,747,538 | 5/1988 | Dunn et al. | 239/20 |

FOREIGN PATENT DOCUMENTS

| | | |
|---|---|---|
| 2534524 | 9/1978 | Fed. Rep. of Germany . |
| 2743713 | 4/1979 | Fed. Rep. of Germany . |

*Primary Examiner*—Tim Miles
*Attorney, Agent, or Firm*—Watson, Cole, Grindle & Watson

[57] ABSTRACT

A movable device for improving the indoor air-environment comprising a water pump, a substantially vertical sheet element (10, 11, 12) which is so arranged that a free falling curtain-like stream of water (17) is formed at the upper end of the sheet element proximate to the sheet element (10, 11, 12) and a tank (9) for collecting and recirculating the water to the water pump. A satisfactory air humidification and an effective removal of impurities in the air are obtained.

10 Claims, 5 Drawing Sheets

AIR HUMIDIFICATION APPARATUS

Figure 1:
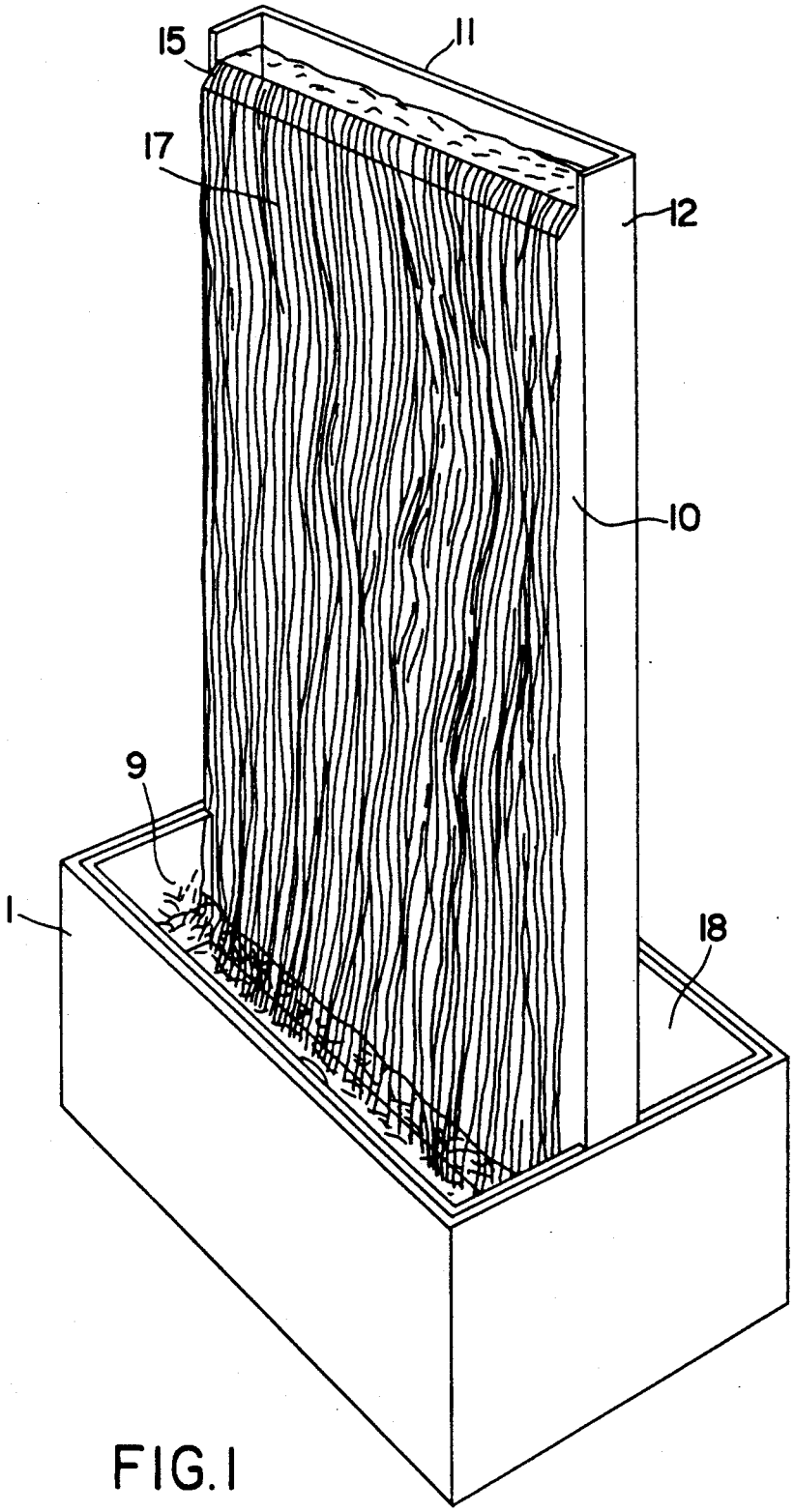

The present invention relates to a device for improving indoor air-environment and in particular for providing a suitable air humidification and absorption of undesired substances as wall as creating a pleasant sight and sound environment, which device comprises a wall and a water pump connected to means for forming a curtain-like stream of water at the upper end of the wall, and a tank located at the lower end of the wall for collecting and recirculating the water to the water pump.

Concurrently with the increasing use of electric appliances and machines in offices and shop premises, major problems of maintaining a healthy and pleasant indoor air-environment in such premises have emerged. The problems are far more pronounced in computer rooms in which large computers are installed which are to operate 24 hours a day, and from which large amounts of air and heat are emitted.

Combined with a greater understanding of the problems facing i.a. allergic subjects this has created a great need for developing devices which can effectively influence the indoor air-environment.

It is known to influence the indoor air-environment by installing central air-condition systems which serve to provide a suitable renewal of air in the rooms connected to the system and to ensure that the room air has a suitable temperature and humidity.

This is effected by means of a system of air channels which are often mounted covered and therefore difficult to gain access to, thereby making them difficult to maintain and clean.

Hence, fungus growth may develop in such channels and in that case fungus spores will quickly spread to all the rooms connected to the system. Furthermore, such systems often give rise to draught resulting in i.a. colds or acute or chronic sinus infections.

Small indoor fountains are known consisting of a tank and a water pump, the suction side of which being connected to the tank and the pressure side being connected to one or more nozzles for producing one or more water jets having such a direction that the water falls back into the tank.

Such fountains produce a plashing or purling sound which is normally perceived as pleasant and soothing and which, to a certain extent, masks sounds which are perceived as unpleasant.

A certain evaporation will occur when the water moves through the air, and to a certain extent the known fountains thus contribute to an increase in the air humidity in the rooms in which they are located.

During the movement of the water some of the components of the room air may be torn out by and optionally absorbed in the water, and consequently a certain purification of the room air is obtained.

However, as the surface of the water jets and drops formed by such fountains is normally small relative to the amount of air present, the air humidification and air purification obtained with the fountains are normally insignificant.

Such indoor fountains suffer from the drawback that they should be placed in a certain distance from other furniture because in case of draught there is a risk that the water jets or drops may spread to a larger area.

Thus, these indoor fountains are not suitable for arrangement of e.g. offices or shop premises.

As for the prior art technique, further reference is made to U.S. Pat. No. 4,747,538 which discloses a device of the type mentioned above. In this known device the wall consists of rectangular plates which are inclined such that the lower edge of one plate overlaps the upper edge of the plate placed below, which in turn at its lower end overlaps the upper edge of the plate placed below. According to this prior art technique the means for forming the curtain-like stream of water are embodied as a row of holes or a slit in a trough into which water is pumped.

The row of holes or the slit is located proximate to the front of the upper edge of the upper plate and in such a manner that the outflowing water immediately hits the plate in question and subsequently flows down along the front of the plate, then immediately down onto the subsequent plate for finally to be caught into the collecting tank. In this case only one side of said water stream is available for air purification and air humidification.

DE-A-2743713 describes a device for improving indoor air environment which comprises a vertical glass plate and a water overflow located at the upper edge of said glass plate, said water overflow creating a stream of water flowing down from the upper edge of the glass plate in contact with said glass plate.

DE-B-2534524 discloses an air humidifier comprising a structure having vertically spaced projections of such a shape that water supplied to the upper projection will flow down over the underlying projections in the form of relatively narrow streams in a cascade-like manner.

The object of the present invention is to obtain a more efficient air humidification and air purification than obtainable with the prior art devices.

This object is obtained with the device according to the invention, which device is characterized in that the plate element comprises water discharge means located at the upper edge of said plate element and extending over the full width thereof, said water discharge means being located at such a distance from the front side of the plate element that both sides of the curtain-like water stream formed by said water discharge means are in contact with the surrounding air.

The invention is based on the discovery that by providing water discharge means generating a curtain-like stream of water extending over the full width of the wall and spaced from said plate element, the surrounding air will be exposed to a much larger water surface than in the prior art devices.

As both air humidification and air purification are proportional to the above mentioned contact area, it is thus possible to obtain a significantly more effective air humidification and air purification than with the known indoor fountains.

The plate element may consist of a single plate but is preferably made up of two plates forming a space between them, the lower end of said space being connected to the water pump and the upper end thereof being connected to the water discharge means at the top.

It is preferred to provide a curtain-like stream of water having the same width from the upper end to the lower end of the plate element. However, in practice it has been found difficult to obtain such a stream. If e.g. the water is allowed to flow out over the upper edge of the plate element in its full width, the water curtain will have the same width as the plate element at the beginning, but the width will rapidly decrease which is unfortunate in case where the largest possible contact area is desired. Esthetic points of view and consideration for the generation of sound may also render it desirable to avoid such a decrease in the width of the water stream and to maintain or reestablish the original width.

This can e.g. be obtained by arranging the plate element in such a manner that the fall of the water is divided into several steps so that a free-falling curtain-like stream of water having the original width is reestablished after each step.

Another possibility is to construct the upper edge of the plate element in a manner so as to form a row of relatively small streams of water. The width of such streams will also decrease but not to the same extent as a stream of full width. The divisional streams formed will together form a stream having a free-falling curtain-like character.

The plate element expediently consists of one or more transparent plates. If the plate element consists of two plate connected along the side edges so as to form a chamber there between for the supply of water to the upper edge of the plate element, the front plate is preferably transparent. Thus it becomes possible to produce special visual effects. Air bobbles may e.g. be blow out at the lower end of the chamber, which bobbles, in that case, will move up through said chamber and produce a spectacular visual impression.

The plate element is expediently constructed with an outwardly extending lip at the upper edge of the element for forming the free-falling curtain-like stream of water in short distance from the plate element.

The lip may extend over the full width of the plate element but it may also be divided into sections to produce several streams of water.

The lip should preferably be integrated with a tank or a groove which allows the introduced water to settle before flowing over the drip.

The stream of water can fall freely from the upper edge of the device to the collecting tank, but often the free fall may advantageously take place in several steps. By allowing the water to move step by step down towards the collecting tank, the water movement is delayed and the circulating amount of water can be reduced accordingly. Furthermore, the above mentioned problem regarding the reduction in the width of the curtain-like stream of water in the fall direction is reduced. Last but not least interruptions in the free fall will increase the contact between air and water which increases the air humidification and the air purification and produces a greater sound effect.

If the water is desired to fall freely in steps, the plate element is preferably constructed in such a manner that the water from a lip at the upper edge of the element falls down like a curtain to a groove or a tank located a distance down the plate and constructed in a manner so as to collect the water stream and to direct the water to a lip from which it falls yet another distance down the plate until it is collected by a further tank or groove, etc. Said tanks or grooves may be of different shape and extension thereby allowing varying stream patterns in the fall direction to be produced.

In a preferred embodiment of the device according to the invention one or more of said tanks or grooves have a rounded form so as to deflect the stream of water and direct it upwards and optionally towards a shield or the like which prevents the water from splashing outside the collecting tank at the lower end of the plate element. By placing such tanks or grooves at various levels the decreasing energy of the water can be used for prolonging the route of the water stream from the upper edge of the plate element to the collecting tank at its lower end, and this causes a significant increase in the area and of the time in which water and room air are in mutual contact resulting in an improved air humidification and air purification.

As mentioned, the water collecting tank serves to collect the falling stream of water so that it can be directed back to the water pump. Optionally the tank may be filled with elements, such a beach stones, which interrupt the stream of water, thereby increasing the contact area between water and air. A particularly large contact area is obtained by using specially shaped elements, such as tubular pieces having substantially the same height and diameter or small saddle shaped elements, instead of round elements. Such types of elements, which are used as fillings in distillation columns and gas scrubbers, are e.g. made of metal, ceramics or plastics.

In the case where a strong purling sound is desired, collecting tanks having a large free surface are preferably used. The collecting tank should have a size allowing it to hold the entire amount of water used in the device, because in case of pump stop, e.g. in connection with electric power failure, the water is collected in the collecting tank.

One or more lamps may be incorporated into the collecting tank for illuminating the front of the plate element or other parts of the device and thereby contributing to the production of a conspicuous esthetic effect.

The water pump may be located in the collecting tank proper but is preferably mounted in a compartment located below the tank. The device may also comprise a filter and measuring and regulating equipment located in the same compartment as the pump or in separate compartments below the collecting tank.

The filter used is preferably a mechanical filter but other filters may also advantageously be incorporated for treatment and purification of the water in the device. For instance charcoal filters may be used for removing dissolved organic substances, e.g. toxic solvents from construction materials, such as paint and lacquers, binders in carpets and joint mortars. Furthermore, by means of such filters substances deriving from tobacco smoking in the room can be absorbed to the extent of which such substances are absorbed in water.

In order to keep the device clean it is an advantage if the circulating water is free of dissolved salts. Distilled or ion-exchanged water can be used. The same kind of water should be used for supplement water to compensate for loses due to evaporation. In large plants where it may be necessary to supplement the water with normal tap water the device may be expediently provided with a built-in deionisation cartridge which can be replaced with a regenerated cartridge at regular intervals.

It is also possible to add desired substances to the water, e.g. substances emitting a faintly pleasant odour, thereby increasing the impression of the environment-improving effect of the device. If desired, substances having a recognized positive effect on the organism, e.g. substances facilitating breathing, may also be added to the water.

As mentioned above the means for directing the water to the upper end of the plate element may consists of a chamber formed between two substantially vertical plates. Thus, in such a plate element the water will flow up within the space between the plates and at the upper edge flow out of the chamber and move like a free-falling curtain-like stream down along at least one side of the element. Said construction may e.g. consist of a 8 mm acrylic plates glued together with a frame on three sides in a manner so as to form a chamber having an internal depth of 10–50 mm and a great extension in both the width and height. The means for transporting the water to the upper end of the plate element may also consist of tube means placed at one or both sides of a plate element. In a further embodiment said means consist of half tubes secured to the plate element.

In a particular embodiment of the device according to the invention the plate element in the form of an acrylic plate is suspended from a wall. At the bottom the plate has a collecting tank formed by bending of the lower edge of the plate. In the collecting tank a small submerged pump may be located which pumps water up into a top tank located at the upper edge of the plate and formed by bending of same via a duct formed by a half tube located at either side of the acrylic plate. The top tank may be provided with holes or slits through which the water can flow and form a free-falling curtain-like stream of water.

The components of the device should be water resistant and preferably be made from materials which are easy to keep clean and cleanse. Examples of such materials are plastic materials, in particular plexi glass, glas, ceramics, marble, stainless steel and other metals.

In order to increase the hygiene the surfaces of the components of the device can be modified with coatings making them smoother, soil repellent, or being bactericide.

As mentioned above the device according to the invention should also give a pleasant sound experience and especially a sound or purling water. Such a sound partly evokes associations of a nature experience and to a large extent will partly be able to mask disturbing sounds generated in the room without acting disturbing itself. At a sound level of 30–40 dB a wide-spectrum sound ("white noise") will make it impossible to understand conversations carried on a greater distance from the listener who, therefore, "unconsciously" ceases to try to follow the conversation and therefore resigns himself.

The device according to the invention aims at providing such a wide-spectrum sound which allows a desired sound picture to be produced by varying the amount of water, the falling height, the water depth in the collecting tank, etc.

If desired, the sound picture thus produced can be supplemented or reinforced electronically.

In this connection it may be desirable to supplement the device with means for controlling its function depending on the noise picture in the room in which it is used.

As mentioned the device according to the invention serves i.a. to regulate the air humidity in the room in which it is placed. This can partly be effected by discharging moisture to dry air or by absorbing water from moist air. Such a discharge/absorption of moisture can be affected by means of the temperature of the circulating water, and hence the device is preferably provided with heating and/or cooling units.

The improvement of the indoor air-environment obtained with the device according to the invention i.a. also manifests itself in that the nuisances caused by static electrical charging are reduced.

In order to reduce or eliminate a tendency for some of the water to fall outside the collecting tank due to air currents in the room in which the device is used, tearring out water drops from the stream of water and in particular from the lower end of the same, a further embodiment of the invention comprises an inclined shield at the lower half of the plate element, said shield extending upwardly and outwardly from the plate element, the lower edge of said shield being placed relative to the plate element so as to form a relatively narrow slit between the two elements. This shield effectively prevents water splash, and surprisingly it has been found to produce simultaneously a significant increase in the air circulation and air humidification in the room in which the device is located.

The increased air circulation and air humidification are assumed to be caused by the fact that the water, which flows sown into the above mentioned slit and which, due to the position of the shield at the lower end of the plate element, has a significant speed of falling, carries along a considerable amount of air. Thus, it has been found that use of the device according to the invention generates a horizontal air stream having a speed of 0.6–1.0 m/sec. in the space in front of said slit.

The outflowing air has a considerable content of water drops which increases the air humidification.

In order to prevent said water drops from falling down on the floor in front of the collecting tank, the tank may be provided with means for directing the air stream in upwards direction before the air passes outside the tank.

In an embodiment of the device according to the invention the above mentioned air-entrainment can be adjusted with the shield arranged pivotably about a horizontal axis. By turning the shield the width of said slit and thus the projection of the shield from the plate element can be regulated as desired.

In a further preferred embodiment of the invention the device has an equalizing tank located at the upper end of the plate element which, via an overflow, is connected to a liquid distribution tank located at the front of the element for producing the free-falling curtain-like water stream. Said liquid distribution tank preferably has a row of holes at the bottom which are so shaped as to form a curtain-like stream of water together.

The presence of said equalizing tank at the upper end of the plate element makes it possible to reduce irregularities in the water stream from the water pump before the water reaches the liquid distribution tank so as to maintain a substantially constant water level therein. Thus, the curtain-like stream of water, which e.g. is formed by the row of holes at the bottom of the liquid distribution tank, is maintained relatively constant.

The pump tube preferably debouches into the bottom of the equalizing tank and in order to moderate fluctuations in the stream of water in the pump tube, a plate is preferably mounted above the upper end of the pump tube for equalization of the liquid stream from the pump.

The overflow between the liquid equalizing tank and the liquid distribution tank preferably comprises a plate provided with a row of parallel, vertical incisions of a suitable depth. Said incisions provide a uniform flow of water to the distribution tank even in case of an unprecise horizontal position of the overflow plate.

The described embodiment of the device according to the invention may be provided with an adjustable guiding plate mounted in such a manner that it extends downwards at an inclined angle into the space below the holes in the distribution tank. A suitable displacement of the guiding plate in the direction towards or away from the plate element produces a free falling curtain-like stream of water in a desired distance therefrom. The plate is preferably adjusted by regulating screws pivotably mounted in holders attached to plates extending from the vertical side edges of the plate element.

Preferably, two filters are mounted on the suction side of the pump, i.a. a coarse filter and a fine filter.

The coarse filter, e.g. in the form of a screen plate, is preferably located above the orifice of the suction tube of the pump in the collecting tank. This filter serves to separate coarse particles.

The other filter, which may be a combined mechanical and chemical filter, is preferably located between the coarse filter and the pump.

The water collecting tank may be divided into an upper and a lower chamber by a perforated horizontal plate onto which a layer of natural stones or other ornamental objects may be placed.

In this embodiment the plate element preferably consists of a transparent plate of plastic, the upper edge of said plate optionally being bent and provided with the above mentioned parallel incisions. Likewise, the lower end of the plastic plate may be bent and preferably the lower edge is located proximate to a source of light, e.g. a fluorescent tube.

The light emitted from said light source will make the entire plate luminous and thereby increase the ornamental effect of the device.

Figure 2:
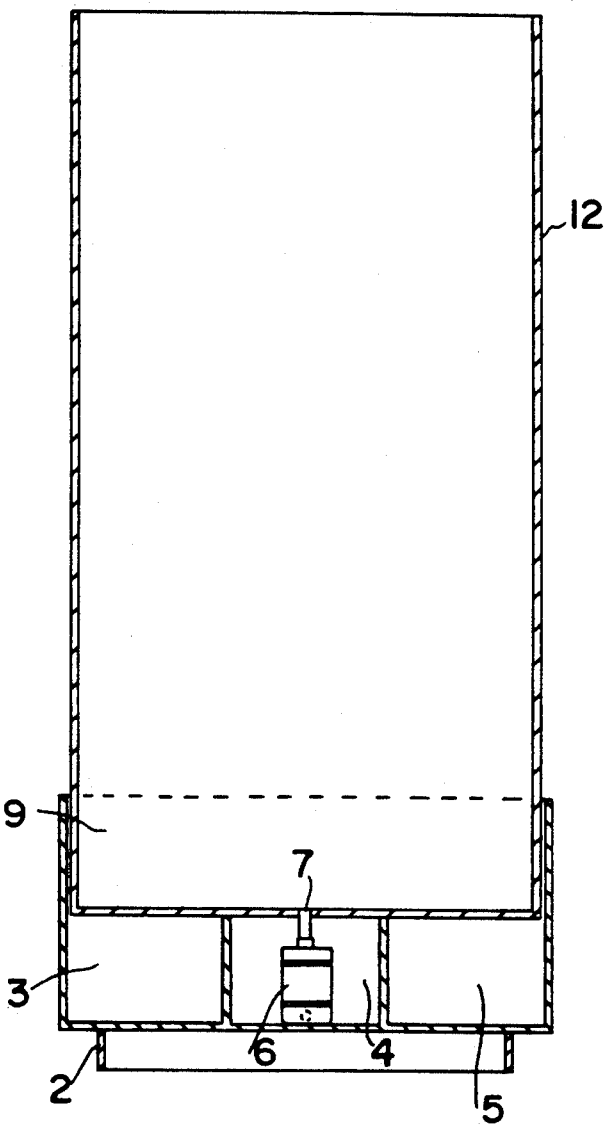
Figure 3:
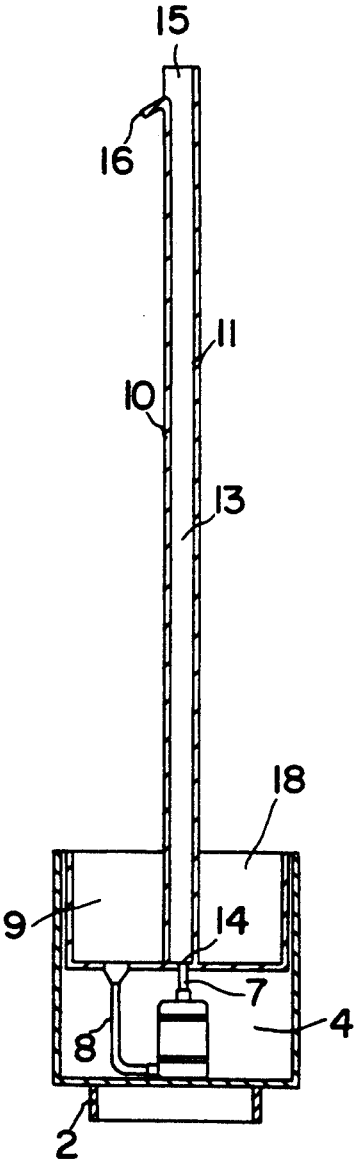
Figure 4:
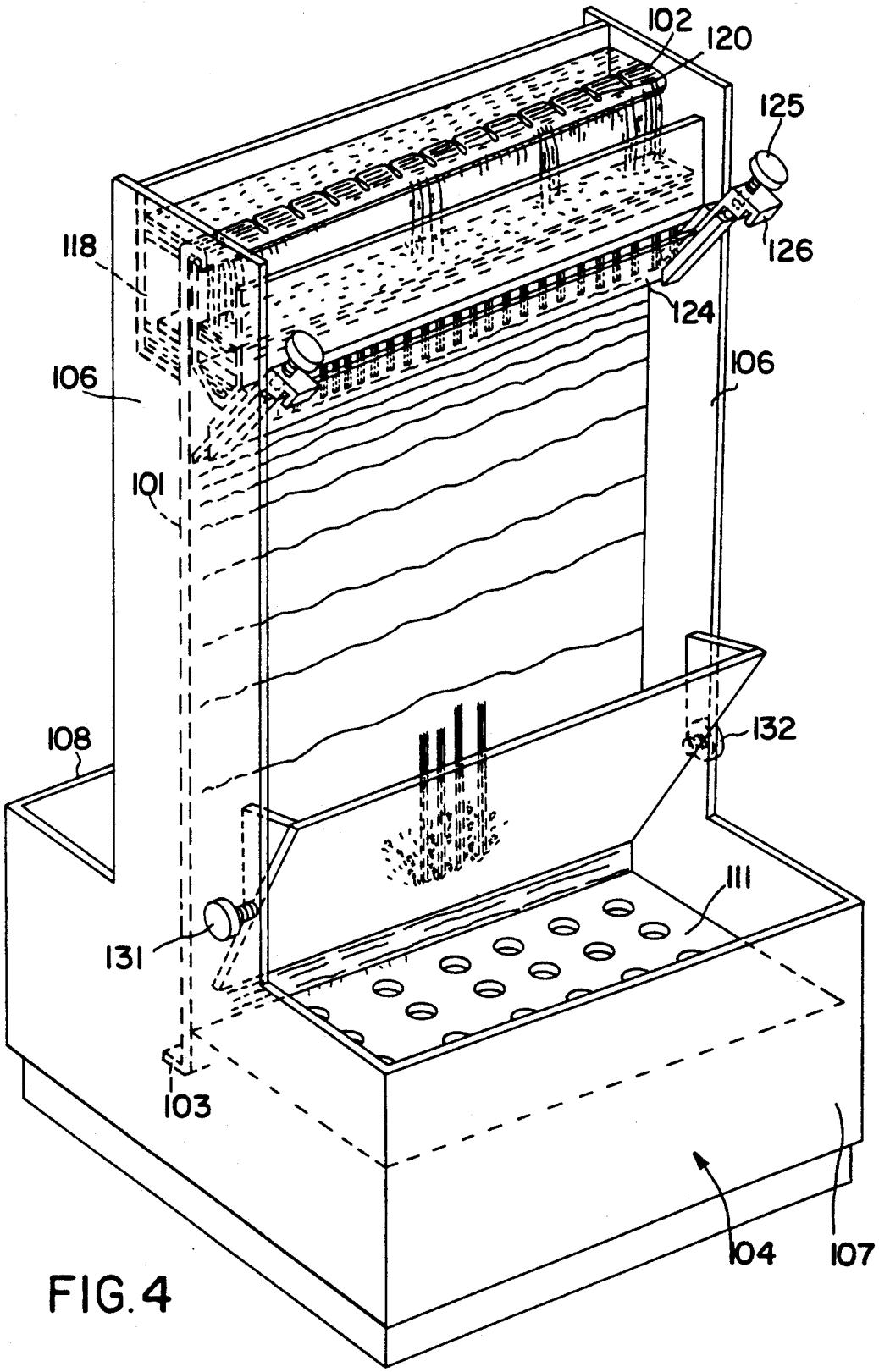
Figure 5:
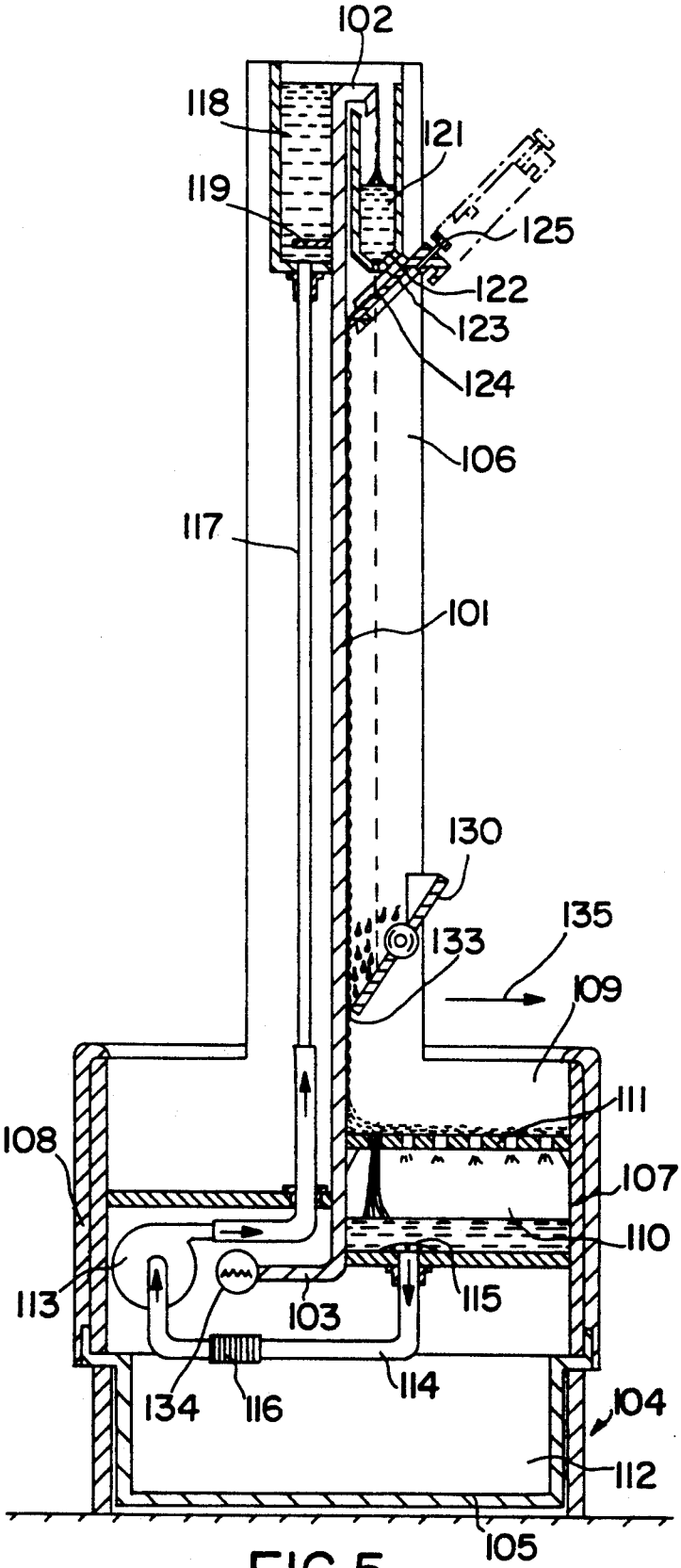
Figure 6:
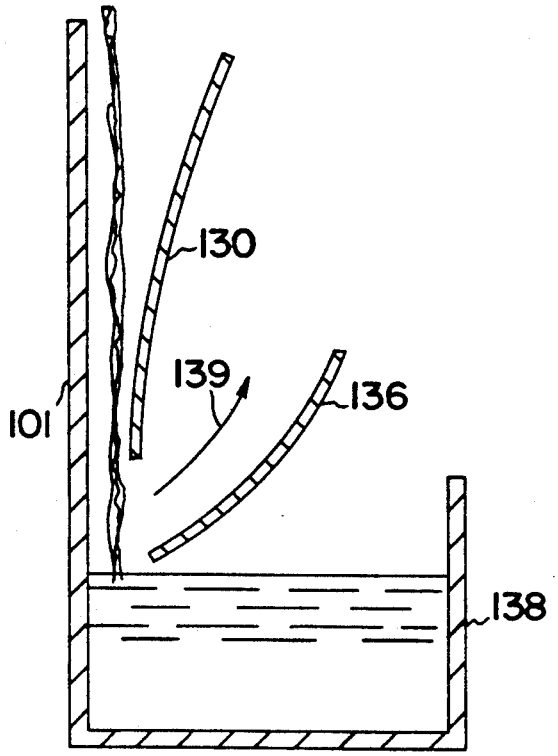
Figure 7:
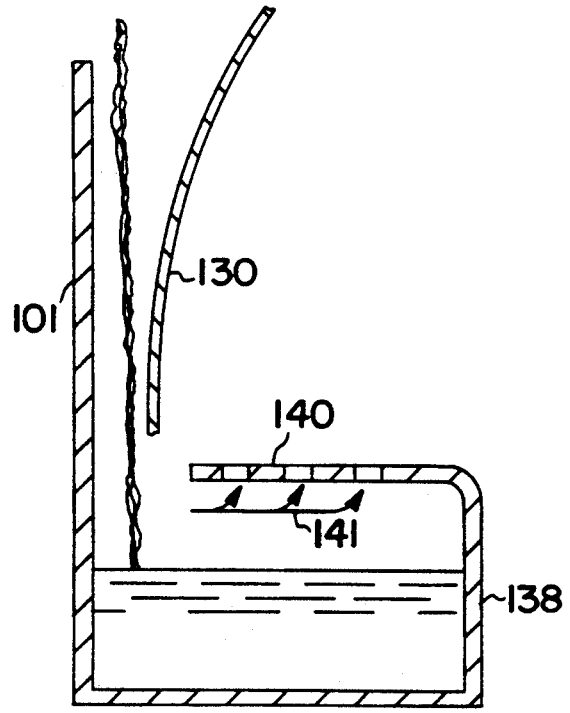

The invention will now be described in further detail with reference to the drawing in which FIG. 1 is a perspective view of a preferred embodiment of the device according to the invention, FIG. 2 is a vertical, longitudinal sectional view of the device as shown in FIG. 1, FIG. 3 is a vertical cross sectional view of the device as shown in FIG. 1, FIG. 4 shows a preferred other embodiment of the device according to the invention in perspective view, FIG. 5 shows the device according to FIG. 4 in a vertical sectional view, and FIG. 6 and 7 show two detailed views of the lower part of the sheet element of two particularly preferred embodiments of the device according to the other embodiment of the invention.

The drawing shows a box 1 having a base 2 which is intended to be loosely placed on a floor. The box 1 is divided into three chambers 3, 4 and 5, a water pump 6 having an outlet tube 7 and an inlet tube 8 being placed in one of the chambers 4.

The other two chambers are intended for holding auxiliary equipment, such as filter, measuring and regulating equipment. The inlet tube 8 is connected to a water collecting tank 9 in which a vertical, hollow sheet element is located, said element consisting of a front plate 10 and a back plate 11 and two side plates 12 connecting the front plate 10 and the back plate 11 at their side edges. Thus, a chamber 13 is formed having a hole 14 at the bottom connected to the outlet tube 7 of the pump 6, and an opening 15 at the top having a drip 16. The device also comprises a chamber 18 located behind the hollow sheet element, which is suitable e.g. as a plant box.

As will appear from FIG. 1 the device shown can provide a curtain-like water stream 17 which falls down towards the tank 9 in a short distance from the front plate 10 and produces a water splash in the tank.

The movement of the water down along the front plate 10 will partly cause an evaporation of water and partly an absorption or air-entrainment of substances contained in the room air, thereby creating an improvement in indoor air-environment.

After the water has optionally been cleaned by filtration the pump 6 again directs it up to the chamber 13 in order that it can be carried over the drip 16 again.

In FIG. 4 and FIG. 5 101 designates a plastic plate which at the upper end has a first bending 102 and at the lower end a second bending 103. The plate 101 is located in a box 104 having a bottom 105, two end walls 106 extending to the upper end of the plate 101, as well as a front plate 107 and a back plate 108. The box 104 comprises two liquid chambers 109 and 110 having a perforated plate 111 mounted between them. In a lower chamber 112 in the box 104 a water pump 113 is located which on the suction side is connected to the liquid chamber 110 via a tube 114. The orifice of the tube 14 which debouches into the liquid chamber 110 is covered by a screen plate 115. A filter 116 is furthermore mounted in the tube 114. The pressure side of the pump 113 is connected to an equilizing tank 118 via a tube 117, said tube debouching into the bottom of the tank 118. In a short distance above the tube orifice a baffle plate 119 is mounted. Spaced vertical incisions 120 are formed in the bended part 102 of the plate 101.

Furthermore, at the upper end of the plate 101 a water distribution tank 121 is located having a tapered bottom 122 in which a row of closely spaced holes are formed.

An adjustable inclined guiding plate 124 is mounted below the bottom 122 of the tank 121. The position of the guiding plate 124 is adjusted by means of regulating screws 125 mounted in holders 126 located at the end plates 106.

The device shown further comprises an adjustable splash shield 130 which is pivotably arranged about a horizontal axis, the angle position of which can be locked by means of regulating screws 131 and 132.

The splash shield 130 is mounted in such a manner that a relatively narrow slit 133 is formed between the lower edge of the shield 130 and the plate 101.

Finally, the device comprises a light source 134 located at the edge of the bending 103 on the plate 101.

The device shown operates in the following manner:

On starting the pump 113 water is pumped from the chamber 110 through the screen plate 115, the filter 116, the pump 113 and the tube 117 to the tank 118. From the tank 118 the water flows through the incisions 120 in the bending 102 to the distribution tank 121. The water flows from the bottom of the tank 121 through the holes 123 down towards the guiding plate 124. Depending on the position of the latter the water moves down towards the tank 104 as a curtain-like stream in a short distance from the plate 101.

During the downward movement the water reaches the space between the shield 130 and the plate 101 and is thereby forced to pass through the slit 133. Having passes the slit 133 the water flows down into the chamber 109 and proceeds through the perforated plate 111 down into the chamber 110.

In the space below the shield 130 a horizontal air stream is generated as indicated by the arrow 135.

In operating the device described above, impurities in the air are entrained by the falling stream of water as it appears from the deposits formed on the filters 115 and 116.

The embodiment shown in FIG. 6 comprises in addition to the plate 101 and the shield 130 a guiding plate 136 having the lower edge located close to the water surface 137 in a tank 138. The presence of said guiding plate 136 causes water drops, which are carried along with the air stream indicated by the arrow 139, to be directed upwards thereby considerably reducing the risk of the drops falling outside the tank 138.

In the embodiment shown in FIG. 7 the tank 138 has a perforated top wall 140 which allows the passage of air and at the same time serves as a baffle plate for water drops contained in an air stream indicated by the arrow 141.

We claim:

1. A device for improving indoor air-environment, and in particular for providing a suitable air humidification and absorption of undesired substances as well as creating a pleasant sight and sound environment, which device comprises a plate element (10; 101) and a water pump (6; 113) connected to water discharge means (16; 121) for forming a curtain-like stream of water (17) at the upper end of the plate element, and a tank (9; 104) located at the lower end of the plate element for collecting and recirculating the water to the water pump (9), wherein the water discharge means (16; 121) are located at such a distance from the front side of the plate element (10; 101) that both sides of the curtain-like water stream formed by said water discharge means (16; 121) are in contact with the surrounding air, and the device further comprises an inclined shield (130) extending upwardly and outwardly from the plate element (101) and being located at the lower half of the plate element (101), the lower edge of said shield being located at such a distance from said plate element that a narrow slit is formed between the shield (130) and the plate element (101).

2. A device according to claim 1 wherein the plate element (10; 101) is composed of plates (10; 11) forming a space (13) therebetween, the lower end of said space being connected with the water pump (6; 113) and the upper end thereof communicating with the water discharge means (16; 121).

3. A device according to claim 1 wherein the tank (104) is divided into an upper and a lower chamber by a perforated horizontal plate (111).

4. A device according to claim 1 wherein the shield (130) is arranged pivotably about a horizontal axis.

5. A device according to claim 1 wherein the tank (104) comprises means (140) for directing an air stream generated below the slit in upward direction before said air flows outside the tank (138).

6. A device according to claim 1 wherein the plate element (101) comprises a transparent plastic plate and that a light source (134) is placed at the lower edge of said plate.

7. A device according to claim 1 wherein comprising an equalizing tank (118) located at the upper end of the plate element (101) which tank (118), via an overflow (102), is connected to a liquid distribution tank (121) located at the front of the plate element (101).

8. A device according to claim 7 wherein the bottom of the liquid distribution tank (121) comprises a row of closely spaced holes (123) located spaced from the front of the plate element (101).

9. A device according to claim 7 wherein the overflow (102) comprises a plate (102) having a row of parallel, vertical incisions (120).

10. A device according to claim 7 comprising a pump tube (117) which debouches into the bottom of the equalizing tank (118), wherein a plate (119) for equalization of the liquid flow from the water pump (113) is located above the upper end of the pump tube (117).

* * * * *